US011952712B2

(12) United States Patent
Harada

(10) Patent No.: US 11,952,712 B2
(45) Date of Patent: Apr. 9, 2024

(54) SYNTHETIC LEATHER AND COVERED ARTICLE

(71) Applicant: Toray Industries, Inc., Tokyo (JP)

(72) Inventor: Masaru Harada, Otsu (JP)

(73) Assignee: Toray Industries, Inc., Tokyo (JP)

( * ) Notice: Subject to any disclaimer, the term of this patent is extended or adjusted under 35 U.S.C. 154(b) by 330 days.

(21) Appl. No.: 17/604,793

(22) PCT Filed: Apr. 17, 2020

(86) PCT No.: PCT/JP2020/016834
§ 371 (c)(1),
(2) Date: Oct. 19, 2021

(87) PCT Pub. No.: WO2020/218177
PCT Pub. Date: Oct. 29, 2020

(65) Prior Publication Data

US 2022/0205168 A1 Jun. 30, 2022

(30) Foreign Application Priority Data

Apr. 25, 2019 (JP) ..... 2019-083665

(51) Int. Cl.
*D06N 3/00* (2006.01)
*D06N 3/14* (2006.01)

(52) U.S. Cl.
CPC ..... *D06N 3/0011* (2013.01); *D06N 3/0034* (2013.01); *D06N 3/14* (2013.01);
(Continued)

(58) Field of Classification Search
CPC ..... D06N 3/0011
See application file for complete search history.

(56) References Cited

U.S. PATENT DOCUMENTS 5,508,080 A 4/1996 Sorimachi et al.
2008/0070465 A1 3/2008 Wiles
(Continued)

FOREIGN PATENT DOCUMENTS

CN 108486906 A 9/2018
CN 109642361 A 4/2019
(Continued)

OTHER PUBLICATIONS

Machine translation of DE 102014015152 (Year: 2014).*
Extended European Search Report dated Jan. 9, 2023, of counterpart European Patent Application No. 20794736.7.
(Continued)

*Primary Examiner* — Zachary M Davis
(74) *Attorney, Agent, or Firm* — DLA Piper LLP (US)

(57) ABSTRACT

A synthetic leather has high flame retardance in addition to excellent mechanical strength and durability, which may yield a covered article having an excellent texture, and a covered article which has been covered with the synthetic leather. The covered article includes a synthetic leather and a covered article covered with the synthetic leather, the synthetic leather having a fiber base material layer including a non-woven fabric containing: a non-melting fiber A having a high-temperature shrinkage rate of 3% or less, and a thermal conductivity, conforming to ISO22007-3 (2008), of 0.060 W/m·K or less; and a thermoplastic fiber B having an LOI value, conforming to JIS K 7201-2 (2007), of 25 or more.

12 Claims, 2 Drawing Sheets

(52) U.S. Cl.
CPC ..... *D06N 2201/0272* (2013.01); *D06N 2209/067* (2013.01); *D06N 2211/14* (2013.01); *D06N 2211/28* (2013.01)

(56) References Cited

U.S. PATENT DOCUMENTS

| | | | |
|---|---|---|---|
| 2015/0132607 | A1 | 5/2015 | Yamanaka et al. |
| 2015/0247282 | A1 | 9/2015 | Veiga et al. |
| 2016/0312400 | A1 | 10/2016 | Casanova Royo |
| 2018/0187351 | A1 | 7/2018 | Tsuchikura et al. |
| 2020/0224341 | A1 | 7/2020 | Harada et al. |

FOREIGN PATENT DOCUMENTS

| | | | |
|---|---|---|---|
| DE | 102014015152 | A1 * | 4/2016 |
| JP | H07-227488 | A | 8/1995 |
| JP | 2010-077554 | A | 4/2010 |
| JP | 4870412 | B2 | 2/2012 |
| JP | 2013-169996 | A | 9/2013 |
| JP | 2014-025156 | A | 2/2014 |
| WO | 2013/187492 | A1 | 12/2013 |
| WO | 2017/006807 | A1 | 1/2017 |

OTHER PUBLICATIONS

Notification of the First Office Action dated Jan. 10, 2023, of counterpart Chinese Patent Application No. 202080028749.0, along with an English translation.

Notification of the Second Office Action dated May 31, 2023, of counterpart Chinese Patent Application No. 202080028749.0, along with an English translation.

Yang et al., "Plastic Molding Technology," Third Edition, Textbook for General Higher Education Planning, China Light Industry Press, p. 419, 2014, along with an English translation.

Notice of Reasons for Rejection dated Sep. 5, 2023, of counterpart Japanese Patent Application No. 2020-544688, along with an English translation.

Rejection Decision dated Aug. 24, 2023, of counterpart Chinese Patent Application No. 202080028749.0, along with an English translation.

A. Zhong, "Clothing Fabric Science," Donghua University Press, 2018, p. 180, along with an English translation.

M. Yang et al., "Plastic Molding Technology," Third Edition, China Light Industry Press, 2014, p. 417-418, along with an English translation.

G. Kellie, "Advanced Nonwoven Materials," High-tech Translation Series on Textile Science and Engineering, China Textile Press Co., Ltd.,, p. 61, 2019, along with an English translation.

* cited by examiner

SYNTHETIC LEATHER AND COVERED ARTICLE

TECHNICAL FIELD

This disclosure relates to a synthetic leather and a covered article covered with a synthetic leather.

BACKGROUND

In recent years, synthetic leather has been used in a wide range of fields such as interior materials for aircraft, automobiles, railways, buildings, and furniture, as a substitute for natural leather. Such synthetic leather or the like is required to have a soft texture, flexibility, mechanical strength, and durability. They are required to have flame retardance performance, due to a disadvantage of being easily combusted.

For example, there are FMVSS-302 and JIS D-1201 for automobile interior materials, a nonmetallic material testing method for railway vehicles and a 45 degree ethyl alcohol method for railway interior materials, and JIS A-1321 for wall covering, and high flame retardance is required to pass these standards.

Furthermore, an aircraft sheet material is required to have flame retardance by a gasoline burner test for the entire sheet obtained by combining a skin material such as synthetic leather with a sheet cushion material, in addition to flame retardance of a synthetic leather alone as in a 12 second or 60 second vertical combustion test, and further required to have higher flame retardance.

The synthetic leather is formed by laminating a skin resin layer of polyurethane, polyolefin, polyvinyl chloride or the like on a fiber base material layer of a woven fabric, a knitted fabric, a non-woven fabric or the like. An adhesive layer may be interposed between the fiber base material layer and the skin resin layer.

As the flame retardation of synthetic leather, a method of making at least one or more of a fiber base material layer, a skin resin layer, and an adhesive layer flame retardant has been reported, and it is roughly classified into a method of using a fiber having high flame retardance as a fiber constituting the fiber base material layer and a method of flame retardation by post-processing. In any of those methods, it is the mainstream to apply a flame retardant by various methods, but in recent years, from the viewpoint of environmental conservation and harmfulness of gas produced during combustion, there has been an increasing demand for flame retardation without using a halogen-based flame retardant, and non-halogen-based flame retardants such as a phosphorus-based material and hydroxides, for example, ammonium phosphate, ammonium sulfamate, ammonium sulfate, borax, boric acid, aluminum hydroxide, magnesium hydroxide, and phosphate esters are known.

Generally, when the flame retardant is added in an amount required to exhibit a flame retardant effect, a water-soluble flame retardant has problems such as thickening and destruction (gumming up) of a synthetic resin emulsion or a solution, a decrease in resin filmed layer strength, a decrease in heat resistance, and a decrease in texture. Water resistance may be poor, a water mark may be produced due to contact with water, or flame retardant performance itself may be deteriorated. To solve those problems, a phosphorus-based flame retardant having a specific structure is disclosed (International Publication No. WO 2013/187492 A).

In addition, there is also disclosed a method of kneading a flame retardant in a fiber constituting a fiber base material layer and setting an LOI value of the fiber itself to 25 or more, thereby improving flame retardance as a fiber base material layer (Japanese Patent Laid-open Publication No. 2019-77554).

However, in the conventional flame-retardant synthetic leather, the synthetic leather alone passes flame retardant tests such as FMVSS-302 or JIS D-1201 for automobile interior materials, a nonmetallic material test method for railway vehicles, a 45 degree ethyl alcohol method, JIS A-1321 for wall covering, and a 12 second or 60 second vertical combustion test for aircraft sheet materials, but when the synthetic leather is used as a skin material and combined with a seat cushion material to form a sheet, the obtained sheet does not have enough flame retardant performance to withstand a gasoline burner test as a whole and it is necessary to dispose thick felt of aramid type or inorganic fibers as a fire-resistant layer between the flame-retardant synthetic leather and the seat cushion material. The sheet on which the fire-resistant layer is disposed as described above has problems in that the sheet is hardened, the volume is increased, and the mass is also increased.

According to the method described in WO '492, when a flame retardant is added to a fiber base material layer by dipping processing, the fiber base material layer is integrated with a urethane-based resin layer, and then further backing processing is performed with a resin containing a flame retardant, the synthetic leather alone passes flame retardant standard tests for various applications, but when the synthetic leather is integrated with the sheet cushion material, the internal sheet cushion material is ignited by heating with a gasoline burner for a certain period of time. Thus, the standard of the aircraft sheet cushion is not satisfied unless a fire-resistant layer made of aramid-based felt is disposed.

In addition, based on the method described in JP '554, when a non-woven fabric felt having a LOI value of 25 or more is produced by using flame-retardant polyethylene terephthalate having a LOI value of 25 or more, in which a flame retardant is kneaded, and a synthetic leather is produced, holes are produced by gasoline burner heating and when integrated with a seat cushion, the cushion material is ignited. Thus, it cannot be said that flame retardance is sufficient.

That is, a synthetic leather which is a flame-retardant synthetic leather of an aircraft sheet and has excellent flame retardance enough to have sufficient flame retardance even when no fire-resistant layer is provided between the synthetic leather and a sheet cushion when the synthetic leather is integrated with the sheet cushion or the fire-resistant layer is thinner and lighter, has not been suggested. Thus, there is room to improve flame retardance as a synthetic leather. This makes it possible to reduce the weight and space of the entire aircraft seat and to improve ride comfort by improving a cushioning property.

Therefore, it could be helpful to provide a synthetic leather having excellent mechanical strength and durability, high flame retardance, and can provide a covered article having an excellent texture, and a covered article covered with the synthetic leather.

SUMMARY

I thus provide:

(1) A synthetic leather including a fiber base material layer formed of a non-woven fabric, the non-woven fabric including: a non-melting fiber A having a high-temperature shrinkage rate of 3% or less and a thermal conductivity, conforming to ISO22007-3 (2008), of 0.060 W/m·K or less, and a thermoplastic fiber B having an LOI value, conforming to JIS K 7201-2 (2007), of 25 or more.

(2) The synthetic leather described in (1), wherein a resin layer is formed on the fiber base material layer.

(3) The synthetic leather described in (2), wherein an adhesive layer is provided between the fiber base material layer and the resin layer.

(4) The synthetic leather described in (2) or (3), wherein in the synthetic leather, a penetration depth of a skin resin layer or the adhesive layer into the fiber base material layer is 0.05 to 0.40 mm.

(5) The synthetic leather described in any one of (1) to (4), wherein a content of the non-melting fiber A is 15 to 70% by mass in the fiber base material layer.

(6) The synthetic leather described in any one of (1) to (5), wherein 20% by mass or less of fiber C other than the non-melting fiber A and the thermoplastic fiber B is included.

(7) The synthetic leather described in any one of (1) to (6), wherein the non-melting fiber A is a flameproofed fiber or a meta-aramid-based fiber.

(8) The synthetic leather described in any one of (1) to (7), wherein the thermoplastic fiber B is a fiber formed of a resin selected from the group consisting of anisotropic molten polyester, flame-retardant poly(alkylene terephthalate), flame-retardant poly(acrylonitrile butadiene styrene), flame-retardant polysulfone, poly(ether-ether-ketone), poly(ether-ketone-ketone), polyethersulfone, polyarylate, polyarylene sulfide, polyphenylsulfone, polyetherimide, polyamideimide, and mixtures thereof.

(9) The synthetic leather described in any one of (1) to (8), wherein the thermoplastic fiber B is a fiber containing 15% by mass or more of a sulfur atom.

(10) The synthetic leather described in any one of (1) to (9), wherein a mass ratio of the fiber base material layer in the synthetic leather is 20 to 80% by mass.

(11) A covered article covered an article with the synthetic leather described in any one of (1) to (10).

(12) The covered article described in (11), wherein the article is a seat cushion material mounted on an aircraft, an automobile, or a ship.

My synthetic leather has excellent mechanical strength and durability, and high flame retardance. In addition, the covered article covered with the synthetic leather has the above configuration, thereby having a soft texture, excellent mechanical strength and durability, and high flame retardance.

DESCRIPTION OF REFERENCE SIGNS

Figure 1:
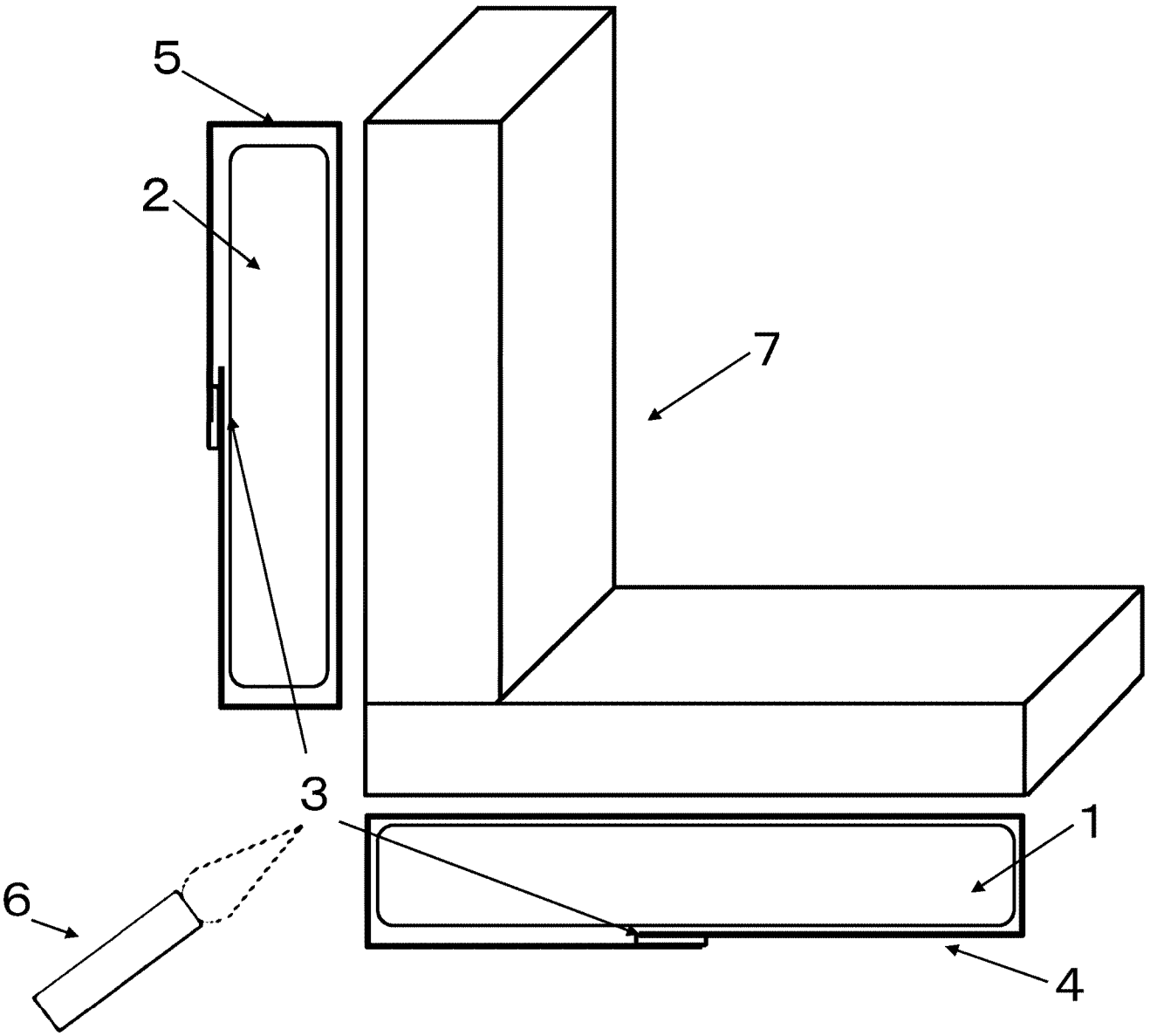
FIG. 1 is an illustration showing a method of assembling a covered article used for a combustion test of an aircraft seat cushion and the combustion test.

1: Urethane foam (seat surface)
2: Urethane foam (back surface)
3: "Velcro (Registered trademark)" tape
4: Skin material (seat surface)
5: Skin material (back surface)
6: Burner
7: Covered article
8: Interface of fiber base material layer in state of having resin layer laminated thereon
9: Interface of permeated resin Layer

DETAILED DESCRIPTION

My synthetic leather includes a fiber base material layer formed of a non-woven fabric, the non-woven fabric including: a non-melting fiber A having a high-temperature shrinkage rate of 3% or less and a thermal conductivity, conforming to ISO22007-3 (2008), of 0.060 W/m·K or less, and a thermoplastic fiber B having an LOI value, conforming to JIS K 7201-2 (2007), of 25 or more, and a covered article covered with the synthetic leather.

High-Temperature Shrinkage Rate

A high-temperature shrinkage rate is a numerical value obtained by allowing a fiber to be a raw material of a non-woven fabric to stand in a standard state (20° C., relative humidity: 65%) for 12 hours, applying a tension of 0.1 cN/dtex to the fiber to measure an original length L10, exposing the fiber to a dry heat atmosphere at 290° C. for 30 minutes without applying a load to the fiber, sufficiently cooling the fiber in the standard state (20° C., relative humidity: 65%), further applying a tension of 0.1 cN/dtex to the fiber to measure a length L1, and determining a value from L0 and L1 by the following formula:

$$\text{High-temperature shrinkage rate}=[(L0-L1)/L0]\times 100\ (\%).$$

When the flame approaches and heat is applied, a thermoplastic fiber melts, and the molten thermoplastic fiber spreads in a thin film shape along the surface of a non-melting fiber (aggregate). When the temperature further rises, both fibers are eventually carbonized, but since the high-temperature shrinkage rate of the non-melting fiber is 3% or less, the vicinity of the flame contact portion at a high temperature is less likely to shrink, and the non-woven fabric is less likely to be broken due to thermal stress generated between a low-temperature portion being not in contact with flame and a high-temperature portion so that flame can be blocked for a long time. This allows excellent flame retardance as a synthetic leather to be achieved. In this respect, it is preferred that the high-temperature shrinkage rate is low, but even when the non-woven fabric is greatly expanded by heat without being shrunk, the non-woven fabric is broken by thermal stress, and thus, it is preferred that the high-temperature shrinkage rate is −5% or more. In particular, the high-temperature shrinkage rate is preferably 0 to 2%.

Thermal Conductivity

A thermal conductivity is obtained by quantifying the ease of heat conduction, and having a low thermal conductivity means that when a material is heated from one surface, the temperature of an unheated portion rises less. A material having a thermal conductivity of 0.060 W/m·K or less as measured by a method in accordance with ISO 22007-3 (2008) and using a felt having a unit weight of 200 g/m$^2$ and a thickness of 2 mm (density: 100 kg/m$^3$) as measured by a method in accordance with JIS L1913 (2010) as a test body hardly transmits heat, and when the material is formed into a non-woven fabric and heated from one surface, a temperature rise on the opposite side being not heated can be suppressed and even if a flammable material is disposed on the opposite side, the inflammable material is less likely to be ignited. Therefore, when an article is covered with my synthetic leather, the flame retardance of the covered article can be maintained. It is preferred that the thermal conductivity is low, but the lower limit of the thermal conductivity for an easily available fiber material is about 0.020 W/m·K.

LOI Value

A LOI value is a volume percentage of a minimum amount of oxygen required to sustain combustion of a substance in a mixed gas of nitrogen and oxygen, and it can be said that the higher the LOI value is, the more difficult it is to burn. Therefore, a thermoplastic fiber having an LOI value, conforming to JIS K 7201-2 (2007), of 25 or more is hard to burn, and even when ignited, the fire is extinguished immediately after a fire source is separated, and a carbonized layer is usually formed in a portion where the fire spreads slightly and the carbonized portion can prevent the spread of the fire. It is preferred that the LOI value is high, but the upper limit of the LOI value of a practically available substance is about 65.

Ignition Temperature

An ignition temperature is a spontaneous ignition temperature measured by a method in accordance with JIS K7193 (2010).

Melting Point

A melting point is a value measured by a method in accordance with JIS K7121 (2012). It refers to a value of a melting peak temperature when heating is performed at 10° C./min.

Non-Melting Fiber A

A non-melting fiber A refers to a fiber which, when exposed to flame, does not liquefy and maintains a fiber shape, and preferably, the fiber does not liquefy and ignite at a temperature of 800° C., and more preferably, the fiber does not liquefy and ignite at a temperature of 1000° C. or higher. Examples of the non-melting fiber having a high-temperature shrinkage rate within my range include flameproofed fibers, meta-aramid-based fibers, and glass fibers.

The flameproofed fiber is a fiber obtained by subjecting a fiber selected from acrylonitrile-based, pitch-based, cellulose-based, phenol-based fibers and the like as a raw material to a flameproofing treatment. These may be used alone or in combination of two or more. In particular, a flameproofed fiber which has a low high-temperature shrinkage rate, undergoes carbonization by an oxygen blocking effect by a filmed layer formed when a thermoplastic fiber B described later is brought into contact with flame, and has further improved heat resistance at a high temperature is preferred, and among various flameproofed fibers, an acrylonitrile-based flameproofed fiber is more preferably used as a fiber which has a small specific gravity, is flexible, and has excellent flame retardance and such a flameproofed fiber is obtained by heating and oxidizing an acrylic fiber as a precursor in hot air. Examples of the commercially available product include a flameproofed fiber PYRON (registered trademark of the United States) manufactured by Zoltek Corporation used in the Examples and the Comparative Examples described later, and Pyromex (registered trademark) manufactured by TOHO Tenax Co., Ltd. In general, the meta-aramid-based fiber has a high high-temperature shrinkage rate and does not satisfy my high-temperature shrinkage rate, but any meta-aramid-based fiber can be preferably used as long as the meta-aramid-based fiber has a high-temperature shrinkage rate within my range by suppressing the high-temperature shrinkage rate.

The non-melting fiber preferably used is used alone or in combination with different materials, and a fiber length is preferably 30 to 120 mm, and more preferably 38 to 70 mm. When the fiber length is 38 to 70 mm, it is possible to form a non-woven fabric by a general needle punch method or a water-jet interlacing method, and it is easy to combine the non-woven fabric with different materials.

The thickness of a single fiber of the non-melting fiber is not particularly limited, but a single fiber fineness is preferably 0.1 to 10 dtex from the viewpoint of a passing property in a carding process.

If the content of the non-melting fiber in the non-woven fabric is too low, a function as an aggregate is insufficient. Thus, a mixing ratio of the non-melting fiber A in the non-woven fabric is preferably 15% by mass or more, and more preferably 20% by mass or more. The upper limit is preferably 80% by mass or less, and more preferably 70% by mass or less, from the viewpoint of productivity of the non-woven fabric and strength of the non-woven fabric.

Thermoplastic Fiber B

The thermoplastic fiber B has a LOI value within my range and melts at a temperature lower than the ignition temperature of the non-melting fiber A, for example, has a melting point lower than the ignition temperature of the non-melting fiber A, and specific examples of the thermoplastic fiber B include fibers composed of a thermoplastic resin selected from the group consisting of flame-retardant liquid crystalline polyester, flame-retardant poly(alkylene terephthalate), flame-retardant poly(acrylonitrile butadiene styrene), flame-retardant polysulfone, poly(ether-ether-ketone), poly(ether-ketone-ketone), polyethersulfone, polyarylate, polyarylene sulfide, polyphenylsulfone, polyetherimide, polyamideimide, and mixtures thereof. These may be used alone or in combination of two or more. When the LOI value is within my range, combustion in air is suppressed, and the polymer is easily carbonized. In addition, since the melting point (in an instance of having no melting point, a melting temperature) is lower than the ignition temperature of the non-melting fiber A, the molten polymer forms a filmed layer on the surface of the non-melting fiber A and between the fibers and the filmed layer is carbonized to increase the effect of blocking oxygen so that oxidative degradation of the non-melting fiber A can be suppressed, and since the carbonized layer exhibits an excellent flame blocking property, when used as a synthetic leather base material, the flame retardance of the entire covered article covered with the synthetic leather can be maintained. In addition, the molten polymer forms a film and is carbonized with the skin resin of the synthetic leather softened by heating and an adhesive, whereby fire spreading on the surface of the synthetic leather can be suppressed.

The melting point of the thermoplastic fiber B (in an instance having no melting point, a melting temperature) is lower than the ignition temperature of the non-melting fiber A, preferably by 200° C. or more, and more preferably by 300° C. or more. Among them, a polyphenylene sulfide fiber (also a PPS fiber) is most preferred from the viewpoint of the height of the LOI value, the range of the melting point, and easy availability. In addition, even a polymer having a LOI value out of my range can be preferably used as long as it has a LOI value falling within my range after being treated with a flame retardant. PPS is most preferred since a sulfur atom is contained in the polymer structure or the flame retardant to develop a mechanism to produce sulfuric acid during thermal decomposition of the polymer or the flame retardant to dehydrate and carbonize the polymer base material, and when the flame retardant is used, a sulfur-based flame retardant is preferred. It is preferred to use a fiber containing 15% by mass or more of a sulfur atom as the thermoplastic fiber B. Specific examples thereof include polyesters to which PPS or a sulfur-based flame retardant is added. The upper limit is preferably 50% by mass or less from the viewpoint of fiber strength.

The ratio of the sulfur atom as used herein can be determined by heating about 10 mg of a sample from room temperature to 800° C. at a rate of 10° C./min under an air flow condition using a thermogravimetric analyzer to oxidatively decompose the thermoplastic fiber, and quantitatively analyzing sulfur oxide in the decomposed gas by gas chromatography.

The thermoplastic fiber B is used as the thermoplastic resin alone or in a manner of combination with different materials, and the fiber length is preferably 30 to 120 mm, and more preferably 38 to 70 mm. When the fiber length is 38 to 70 mm, it is possible to form a non-woven fabric by a general needle punch method or a water-jet interlacing method, and it is easy to combine the non-woven fabric with different materials.

The thickness of a single fiber of the thermoplastic fiber B is not particularly limited, but a single fiber fineness is preferably 0.1 to 10 dtex from the viewpoint of a passing property in a carding process.

The PPS fiber preferably is a synthetic fiber in which a polymer constituent unit is composed of a polymer having —($C_6H_4$—S)— as a main structural unit. Typical examples of the PPS polymers include polyphenylene sulfide, polyphenylene sulfide sulfone, polyphenylene sulfide ketone, random copolymers thereof, block copolymers thereof, mixtures thereof and the like. As a particularly preferable PPS polymer, polyphenylene sulfide containing a p-phenylene unit represented by —($C_6H_4$—S)— as a main structural unit of the polymer in the polymer in an amount of preferably 90 mol % or more is desirable. From the viewpoint of mass, polyphenylene sulfide containing 80% by mass or more, and even 90% by mass or more of the p-phenylene unit is desirable.

The PPS fiber preferably used is used as the PPS fiber unit alone or in combination with different materials, and may be in the form of either a filament or a staple. When a staple is used, the fiber length is preferably 30 to 120 mm, and more preferably 38 to 70 mm. When the fiber length is 38 to 70 mm, it is possible to form a non-woven fabric by a general needle punch method or a water-jet interlacing method, and it is easy to combine the non-woven fabric with different materials. The thickness of a single fiber of the PPS is not particularly limited, but a single fiber fineness is preferably 0.1 to 10 dtex from the viewpoint of a passing property in a carding process.

The method of producing a PPS fiber is preferably a method of melting a polymer having the phenylene sulfide structural unit at or above the melting point and spinning the melted polymer from a spinneret to be a fibrous form. The spun fiber is an as-spun PPS fiber as it is. Most of the as-spun PPS fibers have an amorphous structure and the elongation at break is high. On the other hand, since the fiber has poor dimensional stability due to heat, a drawn yarn, which is oriented by heat-drawing following spinning to improve the strength and thermal dimensional stability of the fiber, is commercially available. A plurality of PPS fibers such as "TORCON" (registered trademark) (manufactured by Toray Industries, Inc.) and "PROCON" (registered trademark) (manufactured by TOYOBO CO., LTD.) are distributed.

The as-spun PPS fiber and the drawn yarn can be used in combination as long as my range is satisfied. Of course, the drawn yarn and the as-spun yarn of the fiber satisfying my range may be used in combination instead of the PPS fiber.

If the mixing ratio of the thermoplastic fiber B in the non-woven fabric to be the fiber base material layer of the synthetic leather is too low, the thermoplastic fibers do not sufficiently spread in a film shape between the non-melting fibers of the aggregate. Thus, the mixing ratio of the thermoplastic fiber B in the non-woven fabric is preferably 10% by mass or more, and more preferably 20% by mass or more. If the mixing ratio of the thermoplastic fiber B is too high, the carbonized portion tends to be brittle at the time of flame contact and holes tend to be formed in a fiber base material layer portion. Thus, the upper limit of the mixing ratio is preferably 85% by mass or less, and more preferably 80% by mass or less.

Fiber C Other than Non-Melting Fiber A and Thermoplastic Fiber B

Fiber C other than the non-melting fiber A and the thermoplastic fiber B may be included to further add specific performance to the non-woven fabric to be the fiber base material layer of the synthetic leather. For example, to improve the wettability of the non-woven fabric, vinylon fiber, modified polyester fiber, nylon fiber or the like may be used. By changing the wettability, the penetration depth of the resin layer into the fiber base material layer in the synthetic leather production process described later can be changed. The mixing ratio of the fiber C is not particularly limited as long as the desired effect is not impaired, but the mixing ratio of the fiber C other than the non-melting fiber A and the thermoplastic fiber B is preferably 20% by mass or less, and more preferably 15% by mass or less. The lower limit in using the fiber C is not particularly limited as long as desired performance is added, but about 10% by mass is usually preferred.

Fiber Base Material Layer Constituting Synthetic Leather

The unit weight of the non-woven fabric of the fiber base material layer constituting the synthetic leather is preferably 50 g/$m^2$ or more, more preferably 100 g/$m^2$ or more, and still more preferably 150 g/$m^2$ or more, and is preferably 450 g/$m^2$ or less, more preferably 400 g/$m^2$ or less, and still more preferably 350 g/$m^2$ or less. When the unit weight of the fiber base material layer is within the above range, a lightweight synthetic leather for aircraft sheet skins having excellent mechanical properties is obtained.

The thickness of the non-woven fabric of the fiber base material layer is measured by a method in accordance with JIS L-1913 (2010), and is preferably 0.4 mm or more. If the thickness of the non-woven fabric is too thin, sufficient mechanical properties as a fiber base material layer cannot be obtained and sufficient flame retardance cannot be obtained, and when a resin layer of the synthetic leather is laminated, the resin layer or the adhesive layer escapes to the back side of the fiber base material layer and the quality of the synthetic leather is impaired. The upper limit of the thickness of the fiber base material layer is not particularly limited, and is preferably set from the mass and thickness of the synthetic leather.

As a form of the fiber used for the non-woven fabric of the fiber base material layer, the number of crimps of the fiber is preferably 7/2.54 cm or more, and more preferably 12/2.54 cm or more, to sufficiently obtain entanglement between fibers. The number of crimps is measured in accordance with JIS L 1015 (2000). The number of crimps is preferably measured in the state of raw cotton, but when it is difficult, may be measured using a sample obtained by decomposing the fiber base material layer.

It is preferred that the lengths of the short fibers of the non-melting fiber A and the thermoplastic fiber B are the same to obtain a more uniform non-woven fabric. The same length may not be exactly the same, and there may be a difference of about ±5% with respect to the length of the non-melting fiber A. From the viewpoint as such, the fiber length of the non-melting fiber and the fiber length of thermoplastic fiber B or the fiber C are preferably 30 to 120 mm, and more preferably 38 to 70 mm.

The non-woven fabric of the fiber base material layer of the synthetic leather is produced by a needle punch method, a water-jet interlacing method or the like, using the short fibers. The structure of the non-woven fabric is not limited as long as it is within my range, but the density of the non-woven fabric is preferably more than 50 kg/m$^3$ and less than 200 kg/m$^3$, more preferably 55 to 180 kg/m$^3$, and still more preferably 70 to 160 kg/m$^3$. If the density is too low, the synthetic leather excessively penetrates into the fiber base material layer when a skin resin layer or an adhesive layer is provided on the fiber base material layer so that the texture of the synthetic leather is excessively hardened or tear strength is decreased. On the other hand, if the density is too high, the fiber base material layer itself is excessively hardened, the texture of the synthetic leather is hardened, or the fiber base material layer is too dense so that adhesive strength with the resin layer or the adhesive layer is decreased. The density is calculated by dividing the mass of a 30 cm square sample by the thickness measured by a method in accordance with JIS L 1913 (2010).

The obtained non-woven fabric may be thermally set using a stenter or calendered. A gray fabric may be used as it is. A heat-set temperature may be a temperature at which the effect of suppressing a high-temperature shrinkage rate is obtained, and is preferably 160 to 240° C., and more preferably 190 to 230° C. A calendering process adjusts the thickness, that is, the density of the non-woven fabric. Therefore, the density is too low, and thus, the synthetic leather excessively penetrates into the fiber base material layer when a skin resin layer or an adhesive layer is provided on the fiber base material layer so that the texture of the synthetic leather may be excessively hardened too much or tear strength may be decreased. Calendering may be performed before the skin resin layer or the adhesive layer is provided. When a non-woven fabric having physical properties within my range is obtained, the speed, pressure, and temperature of the calender are not limited.

Method of Producing Synthetic Leather

The synthetic leather is usually produced by forming a resin layer on a fiber base material layer. A method of forming the resin layer is not particularly limited, and examples thereof include a dry method such as a method of applying a synthetic resin liquefied by a solvent and then drying the solvent to form a resin layer and a method of applying a liquid resin and then reacting the resin to form a resin layer; a lamination method of bonding a resin film made of a synthetic resin; a wet method of applying a liquid resin and then solidifying the resin in a coagulation bath; and the like. In addition, embossing or surface texturing can be performed on the surface of the synthetic leather as necessary to obtain a desired appearance. The resin layer may have a single-layer structure or a multilayer structure of two or more layers, by using the methods alone. In a multilayer structure of two or more layers, each layer can be also formed by combining a plurality of the methods.

Resin Layer

Examples of a synthetic resin to form a resin layer include a polyurethane resin, a polyamide resin, a polyacrylate resin, a vinyl acetate resin, a polyacrylonitrile resin, polyvinyl acetate, an ethylene-vinyl acetate copolymer, styrene-butadiene rubber (SBR), vinyl chloride, vinylidene chloride and the like. The synthetic resins may be used alone or in combination of two or more. Among them, a polyurethane resin is suitable.

A specific constituent component of the polyurethane resin is generally referred to as a polyurethane resin or a polyurethane urea resin, and is obtained by reacting one or a mixture of a polyalkylene ether glycol having a molecular weight of 400 to 4000, a polyester polyol having a hydroxyl group at the terminal, a poly ε-caprolactone polyol, or a polycarbonate polyol with an organic diisocyanate, and is obtained by chain extension with a compound having two active hydrogens as necessary.

Examples of the polyalkylene ether glycol include polytetramethylene ether glycol, polypropylene glycol, polyethylene glycol, a glycerin propylene oxide adduct, polyether polyol with ethylene oxide added at the terminal, and vinyl monomer grafted polyether polyol. Examples of the polyester polyol include those obtained by reacting an alkylene glycol such as ethylene glycol, butylene glycol, hexylene glycol, diethylene glycol, dipropylene glycol, or neopentyl glycol with a carboxylic acid such as succinic acid, glutaric acid, adipic acid, sebacic acid, maleic acid, fumaric acid, phthalic acid, or trimellitic acid so that the terminal is a hydroxyl acid. Examples of the polycarbonate polyol include polyethylene carbonate diol, polytetramethylene carbonate diol, and polyhexamethylene carbonate diol.

Examples of the organic diisocyanate include aromatic isocyanates such as 2,4- and 2,6-tolylene diisocyanate, 4,4'-diphenylmethane diisocyanate, 1,5-naphthalene diisocyanate, and xylylene diisocyanate; and aliphatic isocyanates such as 1,6-hexamethylene diisocyanate, dicyclohexylmethane-4,4'-diisocyanate, 3-isocyanatomethyl-3,5,5'-trimethylcyclohexyl isocyanate, and 2,6-diisocyanate methylcaproate, and these may be used alone or in combination of two or more.

As the chain extender, hydrazine, ethylenediamine, tetramethylenediamine, water, piperazine, isophoronediamine, ethylene glycol, butylene glycol, hexylene glycol, diethylene glycol, dipropylene glycol, neopentyl glycol and the like, or glycols and diamines capable of improving hydrophilicity such as an ethylene oxide adduct to dimethylolpropionic acid and aminoethanesulfonic acid can be used alone or in combination.

As the polyurethane resin, a polycarbonate-based polyurethane resin using polycarbonate polyol as a constituent component is preferable since it has excellent hydrolysis resistance. In particular, a silicone-modified polycarbonate-based polyurethane resin is preferably used for the resin layer present on the outermost surface of the synthetic leather to improve the texture of the synthetic leather.

The silicone-modified polycarbonate-based polyurethane is a polycarbonate-based polyurethane having an organopolysiloxane skeleton in a molecular chain or having an organopolysiloxane skeleton sealed with a functional group nonreactive with an isocyanate group, for example, a trialkylsilyl group, a triarylsilyl group, or the like at a molecular chain terminal.

Adhesive Layer

When the resin layer is laminated by a lamination method, an adhesive is used for bonding a resin film. As the adhesive, an ethylene-vinyl acetate copolymer emulsion, a polyvinyl chloride paste, a polyurethane adhesive, an epoxy adhesive or the like is used. Among them, it is preferred to use a polyurethane-based adhesive in consideration of adhesive strength with the resin layer and prevention of excessive texture hardening by the adhesive.

The polyurethane resin constituting the adhesive may be a polyester-based polyurethane resin, a polyether-based polyurethane resin, a polycarbonate-based polyurethane resin, a mixed system thereof or the like and, for example, is those having an average molecular weight of about 10000 to 40000 obtained from at least one diol selected from polymer diols having an average molecular weight of about 500 to 2500, for example, a polyester diol, a polyether diol, a polyester ether diol, a polycaprolactone diol, a polycarbonate diol and the like, and at least one or more organic polyisocyanates selected from organic polyisocyanates, for example, an aromatic diisocyanate, an aromatic triisocyanate, an alicyclic diisocyanate and the like, and as a urethane resin, a commercially available solution having a solid content of 40 to 70% by mass can be used. In particular, a polyester-based urethane resin is preferred. In addition, a cured product of the adhesive has a 100% modulus of preferably 0.5 to 5 MPa, and particularly preferably 0.5 to 3 MPa in consideration of bending resistance, as measured in accordance with JIS K-6251 (2017).

The adhesive may be applied to the surface of the fiber base material or the surface of a resin sheet. Either of an adhesive for wet lamination in which the fiber base material layer and the skin resin layer are bonded to each other without drying the solvent and an adhesive for dry lamination in which the fiber base material layer and the skin resin layer are bonded to each other after drying the solvent may be used, and a urethane curing agent or a urethanization catalyst can be used to reduce a process load and improve the physical properties of synthetic leather.

Flame Retardant and Other Additives

To further improve the flame retardance, a flame retardant may be included in the resin layer, the adhesive layer, or both. The flame retardant to be used is not particularly limited, and specific examples thereof include inorganic flame retardants such as aluminum hydroxide, titanium oxide, zinc oxide, expandable graphite, magnesium hydroxide, calcium carbonate, zinc borate, ammonium polyphosphate, aluminum diethylphosphinate, and red phosphorus; organic flame retardants such as polyphosphoric acid, melamine, melamine cyanurate, phosphate ester-based compounds, and phosphate ester-based amide-based compounds and the like, and may be used alone or in combination of two or more.

Examples of the phosphate ester-based compound include trioctyl phosphate, triphenyl phosphate, tricresyl phosphate, trixylenyl phosphate, cresyl diphenyl phosphate, cresyl di-2,6-xylenyl phosphate, isopropyl phenyl phosphate, tert-butyl phenyl phosphate, biphenyl diphenyl phosphate, naphthyl diphenyl phosphate, resorcinol bis(diphenyl phosphate), resorcinol bis(dixylenyl phosphate), bisphenol A bis(diphenyl phosphate), tris(chloropropyl) phosphate, tris(dichloropropyl) phosphate, tris(tribromoneopentyl) phosphate and the like.

Among the flame retardants, those which promote carbonization such as a phosphate ester-based compound, a phosphate ester amide-based compound, and aluminum diethylphosphinate, are preferable, from the viewpoint of synergizing with the carbonization action of the fiber base material layer.

The content of the flame retardant included in the resin layer, the adhesive layer, or both is preferably 1 to 300 parts by mass, more preferably 5 to 250 parts by mass, and still more preferably 10 to 200 parts by mass with respect to 100 parts by mass of the solid content of the resin layer or the adhesive layer. Even when the resin layer or the adhesive layer, or both of them do not include a flame retardant at all, the synthetic leather has excellent flame retardant performance as a whole by the excellent flame resistant performance of the fiber base material layer, but when the resin layer or the adhesive layer, or both of them include a flame retardant within the above range, the flame retardant performance of the synthetic leather is further improved. On the other hand, when the content of the flame retardant included in the resin layer, the adhesive layer, or both of them is too high, there are concerns about problems such as a change in appearance such as hardening of texture and a water mark, a decrease in light resistance, and occurrence of delamination of synthetic leather due to a decrease in adhesive strength of the adhesive. The term "water mark" refers to an appearance defect that appears as a stain when droplets of water, alcohol, or the like are dropped and dried and is, for example, a stain portion which occurs when water adheres to synthetic leather including a flame retardant and is dried while a flame retardant is slightly dissolved in the adhered water.

Further, various additives such as an antimicrobial/insect repellent, an antistatic agent, a lubricant, a light resistance improver, a heat resistance improver, an ultraviolet absorber, an antioxidant, a water repellent, a crosslinking agent, a plasticizer, a colorant, and an antifoaming agent; a surfactant such as a dispersant and a penetrant, and a stabilizer such as a thickener; and a filler such as clay, talc, mica, expandable graphite, wollastonite, kaolin, montmorillonite, bentonite, sepiolite, xonotlite, and silica may be added as necessary.

Unit Weight and Thickness of Synthetic Leather and Resin Layer

The thickness of the synthetic leather is preferably 0.5 to 4.0 mm, more preferably 0.7 to 3.5 mm, and still more preferably 0.9 to 3.0 mm from the viewpoint of flame retardant performance, wear durability, texture, and space saving when used as a covering object such as a sheet. When the thickness is smaller than the above range, wear durability is poor, and the flame retardance of the entire covered article such as a sheet when integrated with an article such as a sheet cushion material is deteriorated. On the other hand, when the thickness is larger than the above range, the texture is hardened.

The unit weight of the synthetic leather is preferably 150 to 1000 g/m$^2$, more preferably 170 to 800 g/m$^2$, and still more preferably 200 to 600 g/m$^2$ from the viewpoint of flame retardant performance, wear durability, texture, and weight reduction of a covered article such as a sheet. When the unit weight is less than the above range, wear durability is poor, and the flame retardance of the entire covered article such as a sheet when integrated with an article such as a sheet cushion material is deteriorated. On the other hand, when the unit weight is more than the above range, the entire sheet becomes too heavy and the merit of weight reduction cannot be obtained.

In addition, a mass ratio of the fiber base material layer to the total mass of the synthetic leather is preferably 20% by mass or more, more preferably 30% by mass or more, and still more preferably 40% by mass or more. Since the fiber base material layer constituting the synthetic leather exhibits excellent flame retardant performance as the fiber base material layer alone, when the mass ratio of the fiber base material layer is lower than the above range, there is a concern that the flame retardance of the synthetic leather alone or the covered article such as a sheet may be decreased. On the other hand, the upper limit of the mass ratio of the fiber base material layer is not particularly limited, but is preferably 80% by mass or less, more preferably 75% by mass or less, and still more preferably 70% by mass or less from the viewpoint of achieving the surface feeling and functionality as synthetic leather.

When the resin layer is laminated on the fiber base material layer by a dry method and a wet method, the resin layer is directly applied on or transferred to the fiber base material layer so that the resin layer directly penetrates into the fiber base material layer. On the other hand, when the resin layer is laminated by a lamination method, the resin layer is formed on a release paper or a release film, and is laminated on the fiber base material layer via an adhesive so that the adhesive layer penetrates into the fiber base material layer. The penetration depth of the resin layer or the adhesive layer into the fiber base material layer in the thickness direction of the synthetic leather affects peel strength between the fiber base material layer and the resin layer of the synthetic leather and the texture of the synthetic leather. The penetration depth of the resin layer or the adhesive layer into the fiber base material layer is preferably 0.05 to 0.40 mm, more preferably 0.07 to 0.38 mm, and still more preferably 0.10 to 0.35 mm, from the viewpoint of achieving both the texture of the synthetic leather and the peel strength between the fiber base material layer and the resin layer. When the penetration depth of the resin layer or the adhesive layer into the fiber base material layer is equal to or more than the lower limit of the above range, wear durability of synthetic leather and peel strength between the fiber base material layer and the resin layer are excellent. On the other hand, when the penetration depth of the resin layer or the adhesive layer into the fiber base material layer is equal to or less than the upper limit of the above range, the fiber base material layer does not have a hard texture and is particularly excellent. To set the penetration depth of the resin layer or the adhesive layer into the fiber base material layer within the above range, the molecular weight of the substance described in "Resin layer" or "Adhesive layer," the concentration at which the substance is diluted with a solvent, the temperature and speed at which the solvent is dried in the dry method, the temperature of the coagulation bath and the concentration of the poor solvent in the wet method, and the temperature and pressure at the time of lamination in the lamination method can be appropriately adjusted.

Application of Synthetic Leather

The thus-obtained synthetic leather has excellent flame retardance and also has excellent physical properties such as texture and peel strength, and the flame retardant performance is effective not only for the synthetic leather alone but also for the entire covered article when the synthetic leather covers an article such as a cushion foam. Therefore, the synthetic leather can be used as a mounting material covering a seat cushion material or the like in addition to being directly used as decoration of a ceiling or a wall surface. Among them, the synthetic leather can be particularly suitably used as a mounting material for covering a seat cushion material mounted on automobiles, railways, and ships which are required to have high flame retardance, and a mounting material for chairs and sofas in high-rise buildings and public facilities.

EXAMPLES

Next, my synthetic leather and articles will be described in detail, based on the Examples. However, this disclosure is not limited only to the Examples. Various modifications and corrections can be made without departing from the technical scope of this disclosure. Methods of measuring various properties used in the Examples are as follows.

Unit Weight of Fiber Base Material Layer

The mass of a 30 cm square sample was measured and expressed in mass per 1 $m^2$ ($g/m^2$). When it is difficult to measure the fiber base material layer alone in a state where the measurement sample is synthetic leather, a value calculated by peeling off and removing the resin layer using a synthetic leather sample of an arbitrary area and dividing the mass of the fiber base material portion by the sample area may be used.

Unit Weight of Synthetic Leather

The mass of a 30 cm square sample was measured and expressed in mass per 1 $m^2$ ($g/m^2$). When the measurement sample is smaller than a 30 cm square, a value calculated by dividing the sample mass by the area of the sample may be used.

Unit Weight of Resin Layer/Adhesive Layer

It is defined as a mass difference ($g/m^2$) between the [unit weight of synthetic leather] and the [unit weight of fiber base material layer].

Mass Ratio of Fiber Base Material Layer to Entire Synthetic Leather

It is a ratio (%) obtained by dividing the [unit weight of fiber base material layer] by the [unit weight of synthetic leather].

Thickness of Fiber Base Material Layer

The thickness of the fiber base material layer was measured in accordance with JIS L-1913 (2010). When the measurement sample was in a state of synthetic leather and it was difficult to perform measurement with the fiber base material layer alone, in the cross section of the sample, imaging was performed at a magnification at which the entire synthetic leather in the thickness direction was about 50 to 90% of an imaging range of a scanning electron microscope (SEM) (specifically, about 30 to 200 times), and at any 5 places in the cross-sectional photograph, the thickness of the fiber base material layer portion was read on a scale and an average value thereof may be used as the thickness of the fiber base material layer.

Thickness of Synthetic Leather

The thickness of synthetic leather was measured in accordance with JIS L-1913 (2010).

Figure 2:
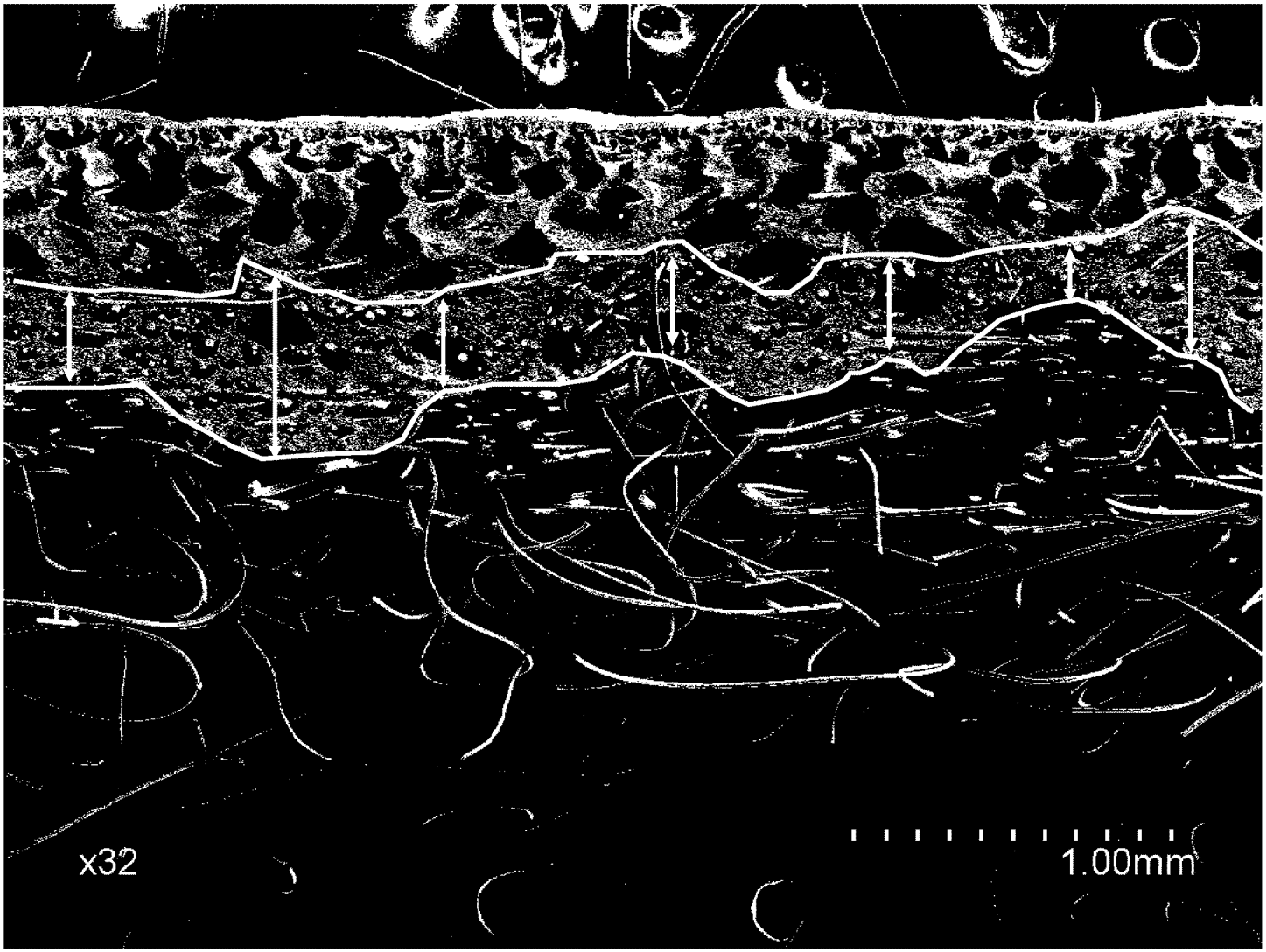
FIG. 2 is a cross-sectional view of the synthetic leather for measuring a penetration depth of a resin layer or an adhesive layer into a fiber base material layer.

Penetration Depth of Resin Layer or Adhesive Layer into Fiber Base Material Layer in Thickness Direction of Synthetic Leather In the cross section of the synthetic leather, imaging was performed at a magnification at which the entire in the thickness direction was 50 to 90% of the imaging range of the SEM and the permeation portion of the resin layer and the interface of the fiber base material layer can be clearly observed (specifically, about 30 to 100 times), and at 20 places at constant intervals in the width direction in the cross-sectional photograph, the depth at which the resin layer or the adhesive layer penetrated into the fiber base material layer was read on a scale and the average value thereof was taken as the penetration depth of the resin layer or the adhesive layer into the fiber base material layer in the thickness direction of the synthetic leather. When the thickness of the synthetic leather was small and the observation magnification was too large, the same measurement was performed by moving the observation field of view, and the measurement was performed for at least 1 mm continuously in the length direction of the sample and the average value of the penetration depths at all points was adopted. FIG. 2 is a cross-sectional photograph of the synthetic leather, in which 8 shows an interface of a fiber base material layer in a state in which a resin layer is laminated and 9 shows an interface of the penetrated resin layer, and the penetration depth of the resin layer or the adhesive layer into the fiber base material layer in the thickness direction of the synthetic leather refers to a distance between 8 and 9 in the drawing.

Tensile Strength of Synthetic Leather

In accordance with ASTM D-751 (2011), when a sample cut into a width of 25.4 mm (1 inch) was stretched at a distance between chucks of 152 mm at a tensile speed of 152 mm/min, a maximum load until the sample was broken was divided by the sample width, and a breaking load per 25.4 mm (1 inch) was defined as a tensile strength (N/25.4 mm). The measurement was performed with N=3 and the average value thereof is shown.

Tensile Elongation of Synthetic Leather

In accordance with ASTM D-751 (2011), when a sample cut into a width of 100 mm was stretched at a distance between chucks of 152 mm at a tensile speed of 152 mm/min, the elongation of the sample at the time of being broken was defined as a ratio (%) obtained by dividing the elongation amount of the sample by the test length of the sample of 152 mm. The measurement was performed with N=3 and the average value thereof is shown.

Tear Strength of Synthetic Leather

In accordance with ASTM D-5733 (1999), tear strength (N) was measured by a trapezoid method and is shown as an average value of N=3.

Peel Strength of Synthetic Leather

In accordance with ASTM D-903 (2017), a resin layer at one end of a sample having a width of 25.4 mm (1 inch) was peeled off from the fiber base material layer and was heat-set on a chuck. In this state, the resin layer and the fiber base material layer were torn off at a speed of 300 mm/min in the direction of 180 degrees. The average value of the peeling load in 127 mm (5 inches) from the position of 25.4 mm (1 inch) from the start of tearing off to 152.4 mm (6 inches) was divided by a sample width, and the peeling load (N/25.4 mm) per 25.4 mm (1 inch) was defined as the peel strength. The measurement was performed with N=3 and the average value thereof is shown.

Wear Durability of Synthetic Leather

In accordance with ASTM D-4157 (2017), a Wyzenbeek abrasion test was performed with N=3 using a load of 1361 gf (3 Lb) (13.3 N), a tension of 1814 gf (4 Lb) (17.8 N), and No. 10 canvas as a friction cloth. When no scratch or peeling of the resin layer was observed on the surface of the synthetic leather after 3000 wear cycles was determined as pass and indicated as A. When scratches or peeling of the resin layer was observed was determined as fail and indicated as F.

Seam Strength of Synthetic Leather

In accordance with a seam strength grab method of ASTM D-751 (2011), a breaking strength at the seam portion when two sheets of synthetic leather were sewn and the seam was pulled in the direction of 180 degrees was divided by a sample width, which was expressed as N/25.4 mm. The test was performed with N=3, and the average value thereof is shown.

Flame Retardant Test for Automobile Interior Materials of Synthetic Leather

In accordance with a horizontal combustion test FMVSS No. 302 for automobile interior materials defined in JIS D 1201 (1998), a combustion speed of 4 inches (102 mm)/min or less was determined as pass, a combustion speed of 4 inches (102 mm)/min or less was indicated as B, a combustion speed of 3 inches (76 mm)/min or less was indicated as A, and a failure was indicated as F.

Flame Retardant Test for Aircraft Interior Materials of Synthetic Leather

A 12-second vertical combustion test was performed as specified in 14CFR Part25 Section 25.853(a) and Appendix Fto Part 25, Part I, and a flame time of 15 seconds or less, a drip flame time of 5 seconds or less, and a burn length of 203 mm (8 inches) or less was determined as pass and indicated as A, and other samples were indicated as F.

Flame Retardant Test of Aircraft Seat Cushion

A combustion test was performed in accordance with the gasoline burner test specified in 14 CFR Part 25 Section 25.853 (c) Appendix F Part 25, Part II. FIG. 1 is an illustration showing a method of assembling a covered article to evaluate flame retardance of the covered article used for a combustion test of an aircraft seat cushion and the combustion test. A soft urethane foam commercially available from FUJI RUBBER SANGYO CO., LTD. was cut into a size of 450 mm×500 mm for a seat surface and a size of 450 mm×630 mm for a rear surface to obtain a urethane foam (seat surface) 1 and a urethane foam (back surface) 2, respectively. A "Velcro (registered trademark)" tape 3 made of polyphenylene sulfide was attached to the synthetic leather by sewing with a meta-aramid yarn to prepare a skin material (seat surface) 4 and a skin material (back surface) 5. The skin material (seat surface) 4 and the skin material (back surface) 5 covered the urethane foam (seat surface) 1 and the urethane foam (back surface) 2, respectively, which were fixed to an L-shaped frame (not shown) to assemble a covered article 7. Sample mass was measured before the test. Heating was performed for 2 minutes by a burner 6 from the side surface of the heat-set sample, and the temperature of the burner was set such that the lowest temperature and the highest temperature measured at 5 places in the width direction in the root portion of the burner port were 1000±20° C. After heating, the burner was separated from the sample and the sample was allowed to stand for 5 minutes. The sample mass was measured after being allowed to stand for 5 minutes. When, after the sample was allowed to stand for 5 minutes, flame ignited on the sample was completely extinguished, the burn lengths of the front and rear sides of the back cushion and the bottom and upper portions of the seat cushion were all 432 mm (17 inches) or less, and the mass loss of the sample after the test was 10.0% or less was determined as pass, and among them, the mass loss of 5.0% or less was indicated as A, and the mass loss of more than 5.0% and 10.0% or less was indicated as B. When, after the sample was allowed to stand for 5 minutes, flame ignited on the sample was not extinguished, the burn length was more than 432 mm (17 inches), or the mass loss of the sample was more than 10.0% was determined as fail and indicated as F.

Sensory Evaluation of Texture of Cushion Covered with Synthetic Leather

In the same manner as the sample of "Flame retardant test of aircraft seat cushion" described above, a urethane cushion was covered with the synthetic leather and mounted. The touch and seating comfort of the sample were evaluated on a scale of 1 to 5 (1: hard, not comfortable to sit, 5: soft, comfortable to sit) by five people, and the average score is shown.

Fibers Constituting Fiber Base Material Layer

Non-Melting Fiber A 1.7 dtex flameproofed fiber "PYRON" (registered trademark of the United States) manufactured by Zoltek Corporation having a length of 51 mm, a high-temperature shrinkage rate of 1.6%, and a thermal conductivity of 0.033

W/m·K (200 g/m$^2$, measured by manufacturing a 2 mm thick needle punch felt). Number of crimps: 12 (crimps/25 mm), crimp ratio: 12%.

The number of crimps and the crimp ratio were measured in accordance with JIS L 1015 (2000).

Thermoplastic Fiber B-1

"TORCON" (registered trademark) product number S371 manufactured by Toray Industries, Inc., which is a drawn PPS fiber having a single fiber fineness of 2.2 dtex (diameter: 14 μm) and a cut length of 51 mm, of LOI value: 34, melting point: 284° C., glass transition temperature: 90° C., number of crimps: 14 (crimps/25 mm), and crimp ratio: 18%. The ratio of a sulfur atom in the fiber was 26.2% by mass.

Thermoplastic Fiber B-2

"TORCON" (registered trademark) product number S311 manufactured by Toray Industries, Inc., which is an as-spun PPS fiber having a single fiber fineness of 6.0 dtex (diameter: 23 μm) and a cut length of 51 mm, of LOI value: 34, melting point: 280° C., glass transition temperature: 90° C., number of crimps: 16 (crimps/25 mm), and crimp ratio: 22%. The ratio of a sulfur atom in the fiber was 26.1% by mass.

Other Fiber C-1

"TETORON" (registered trademark) product number T9615 manufactured by Toray Industries, Inc., which is a polyethylene terephthalate (PET) fiber having a single fiber fineness of 2.2 dtex (diameter: 14 μm) and a cut length of 51 mm, of LOI value: 22, melting point: 256° C., number of crimps: 16 (crimps/25 mm), and crimp ratio: 17%.

Other Fiber C-2

"ARAWIN" (registered trademark) manufactured by Toray Chemical Korea Co., Ltd., which is a meta-aramid fiber having a single fiber fineness of 1.7 dtex (diameter: 13 μm) and a cut length of 51 mm, of LOI value: 26, melting point: 428° C., high-temperature shrinkage rate: 6.7%, number of crimps: 11 (crimps/25 mm), and crimp ratio: 9%.

Other Fiber C-3

Commercially available common rayon (no flame retardant kneaded therein) having a single fiber fineness of 2.2 dtex (diameter: 14 μm) and a cut length of 51 mm, of LOI value: 17, no melting point, high temperature shrinkage rate: 25.3%, number of crimps: 13 (crimps/25 mm), and crimp ratio of 13%.

Synthetic Resin Constituting Resin Layer

Polyurethane Resin D-1

A commercially available common yellowing-free polycarbonate type polyurethane having a 100% modulus of 2 to 10 MPa was used.

Polyurethane Resin D-2

A commercially available common silicone-modified yellowing-free polycarbonate type polyurethane having a 100% modulus of 5 to 10 MPa was used.

Adhesive Constituting Adhesive Layer

A commercially available common polycarbonate type polyurethane-based adhesive was used.

Flame Retardant

Pekoflam STC (main component: aluminum diethylphosphinate) manufactured by Archroma Japan K.K. was used.

Example 1

Production of Fiber Base Material Layer

A drawn PPS fiber and a flameproofed fiber were mixed by a fiber opening machine and then further mixed by a cotton mixing machine, and then a web was made by a carding machine. The obtained web was laminated by a cloth lapping machine, and then felted by a needle punch machine to obtain a non-woven fabric composed of a drawn yarn of PPS fibers and flameproofed fibers. The non-woven fabric had a mass mixing ratio of the drawn yarn of the PPS fiber and the flameproofed fiber of 60:40, a unit weight of 181 g/m$^2$, and a thickness of 1.51 mm.

Production of Synthetic Leather

The non-woven fabric obtained by the above method was used as a fiber base material layer, and an aqueous polyvinyl alcohol solution having a polymerization degree of 500 and a saponification degree of 92% was dipped. The polyvinyl alcohol solid content was 12 parts by mass with respect to 100 parts by mass of the fiber base material layer. Next, a solution containing 15 parts by mass of a flame retardant with respect to 100 parts by mass of the polyurethane resin D-1 was prepared and applied on the fiber base material layer with a knife coater. The applied fiber base material layer was washed with warm water at 60° C. to replace the previously applied polyvinyl alcohol, and then dried in an oven at 120° C. to obtain a wet synthetic leather. A deposition amount of the polyurethane resin calculated from the mass of the dried sample was 188 g/m$^2$. Further, the polyurethane resin D-2 dissolved in a solvent was applied on release paper with a comma coater to be 30 g/m$^2$ and dried to prepare a film. About 20 g/m$^2$ of a mixture of 100 parts by mass of an adhesive and 15 parts by mass of a flame retardant was applied on the film, and the film bonded to the wet synthetic leather and subjected to an aging treatment. The synthetic leather after being bonded to the film had a unit weight of 415 g/m$^2$ and a thickness of 1.32 mm. The penetration depth of the resin layer and the adhesive layer into the fiber base material layer calculated from the SEM photograph of the cross section of the obtained synthetic leather was 0.29 mm.

Evaluation of Various Physical Properties

The mechanical properties and wear durability are as shown in Table 1, and sufficient physical properties as a synthetic leather were satisfied. In addition, self-extinguishing in a 38 mm marked line was observed in the flame retardant test for automobile interior materials, both afterflame and drip combustion were not observed in the flame retardant test for aircraft interior materials, and favorable results were obtained with a burn length of 61 mm in the machine direction and 69 mm in the transverse direction. The obtained synthetic leather covered a urethane cushion and a flame retardant test of the sheet cushion was performed and, as a result, the burn length was within the pass range, and the mass loss was as excellent as 4.9%. In addition, the texture of the obtained cushion was soft and good.

Example 2

Production of Fiber Base Material Layer

A non-woven fabric was produced in the same manner as in Example 1, except that the unit weight was changed to 231 g/m$^2$ and the thickness was changed to 1.57 mm.

Production of Synthetic Leather

A synthetic leather was produced in the same manner as in Example 1, except that the unit weight after drying of the polyurethane resin D-1 and the flame retardant constituting the wet synthetic leather was changed to 131 g/m$^2$, the non-woven fabric obtained by the above method was used as a fiber base material layer, the unit weight of the synthetic leather after being bonded to a film changed to 413 g/m$^2$, and the thickness changed to 1.39 mm. The penetration depth of the resin layer and the adhesive layer into the fiber base material layer calculated from the SEM photograph of the cross section of the obtained synthetic leather was 0.21 mm.

Evaluation of Various Physical Properties

The mechanical properties and wear durability are as shown in Table 1, and sufficient physical properties as a synthetic leather were satisfied. In addition, self-extinguishing in a 38 mm marked line was observed in the flame retardant test for automobile interior materials, both after-flame and drip combustion were not observed in the flame retardant test for aircraft interior materials, and favorable results were obtained with a burn length of 58 mm in the machine direction and 60 mm in the transverse direction. The obtained synthetic leather covered a urethane cushion and a flame retardant test of the sheet cushion was performed and, as a result, the burn length was within the pass range, and the mass loss was as excellent as 3.9%. In addition, the texture of the obtained cushion was soft and good.

Example 3

Production of Fiber Base Material Layer

A non-woven fabric was produced in the same manner as in Example 1, except that the mass ratio of the drawn PPS fiber and the flameproofed fiber was changed to 90:10, the unit weight was 178 g/m$^2$, and the thickness was 1.42 mm.

Production of Synthetic Leather

A synthetic leather was produced in the same manner as in Example 1, except that the unit weight after drying of the polyurethane resin D-1 and the flame retardant constituting the wet synthetic leather was changed to 186 g/m$^2$, the non-woven fabric obtained by the above method was used as a fiber base material layer, the unit weight of the synthetic leather after being bonded to a film changed to 409 g/m$^2$, and the thickness changed to 1.34 mm. The penetration depth of the resin layer and the adhesive layer into the fiber base material layer calculated from the SEM photograph of the cross section of the obtained synthetic leather was 0.19 mm.

Evaluation of Various Physical Properties

The mechanical properties and wear durability are as shown in Table 1, and sufficient physical properties as a synthetic leather were satisfied. In addition, self-extinguishing in a 38 mm marked line was observed in the flame retardant test for automobile interior materials, both after-flame and drip combustion were not observed in the flame retardant test for aircraft interior materials, and favorable results were obtained with a burn length of 120 mm in the machine direction and 110 mm in the transverse direction. The obtained synthetic leather covered a urethane cushion and a flame retardant test of the sheet cushion was performed and, as a result, the burn length was within the pass range, and the mass loss was 9.5%, which was within the pass range. In addition, the texture of the obtained cushion was soft and good.

Example 4

Production of Fiber Base Material Layer

A non-woven fabric was produced in the same manner as in Example 1, except that the mass ratio of the drawn PPS fiber and the flameproofed fiber was changed to 20:80, the unit weight was 171 g/m$^2$, and the thickness was 1.59 mm.

Production of Synthetic Leather

A synthetic leather was produced in the same manner as in Example 1, except that the unit weight after drying of the polyurethane resin D-1 and the flame retardant constituting the wet synthetic leather was changed to 178 g/m$^2$, the non-woven fabric obtained by the above method was used as a fiber base material layer, the unit weight of the synthetic leather after being bonded to a film changed to 394 g/m$^2$, and the thickness changed to 1.43 mm. The penetration depth of the resin layer and the adhesive layer into the fiber base material layer calculated from the SEM photograph of the cross section of the obtained synthetic leather was 0.31 mm.

Evaluation of Various Physical Properties

The mechanical properties and wear durability are as shown in Table 1, and sufficient physical properties as a synthetic leather were satisfied. In addition, self-extinguishing in a 38 mm marked line was observed in the flame retardant test for automobile interior materials, both after-flame and drip combustion were not observed in the flame retardant test for aircraft interior materials, and favorable results were obtained with a burn length of 65 mm in the machine direction and 70 mm in the transverse direction. The obtained synthetic leather covered a urethane cushion and a flame retardant test of the sheet cushion was performed and, as a result, the burn length was within the pass range, and the mass loss was 8.1%, which was within the pass range. In addition, the texture of the obtained cushion was soft and good.

Example 5

Production of Fiber Base Material Layer

A non-woven fabric was produced in the same manner as in Example 1, except that a PET fiber was also used in addition to the drawn PPS fiber and the flameproofed fiber so that the mass ratio of the drawn PPS fiber, the flameproofed fiber, and the PET fiber was changed to 30:40:40, the unit weight was 179 g/m$^2$, and the thickness was 1.49 mm.

Production of Synthetic Leather

A synthetic leather was produced in the same manner as in Example 1, except that the unit weight after drying of the polyurethane resin D-1 and the flame retardant constituting the wet synthetic leather was changed to 176 g/m$^2$, the non-woven fabric obtained by the above method was used as a fiber base material layer, the unit weight of the synthetic leather after being bonded to a film changed to 401 g/m$^2$, and the thickness changed to 1.35 mm. The penetration depth of the resin layer and the adhesive layer into the fiber base material layer calculated from the SEM photograph of the cross section of the obtained synthetic leather was 0.35 mm.

Evaluation of Various Physical Properties

The mechanical properties and wear durability are as shown in Table 2, and sufficient physical properties as a synthetic leather were satisfied. In addition, in the flame retardant test for automobile interior materials, the synthetic leather was burned beyond the 38 mm marked line, but the combustion speed was 78 mm/min, which was within the pass range. In the flame retardant test for aircraft interior materials, the synthetic leather with after-flame of 1.2 seconds in the machine direction and 1.5 seconds in the transverse direction, a drip combustion of 0.5 seconds in the machine direction and 1.0 seconds in the transverse direction, and a burn length of 109 mm in the machine direction and 119 mm in the transverse direction was within the pass range. The obtained synthetic leather covered a urethane cushion and a flame retardant test of the sheet cushion was performed and, as a result, the burn length was within the pass range, and the mass loss was 9.9%, which was within the pass range. In addition, the texture of the obtained cushion was soft and good.

Example 6

Production of Fiber Base Material Layer

A non-woven fabric was produced in the same manner as in Example 1, except that the unit weight was 82 g/m$^2$ and the thickness was 0.83 mm.

Production of Synthetic Leather

A synthetic leather was produced in the same manner as in Example 1, except that the unit weight after drying of the polyurethane resin D-1 and the flame retardant constituting the wet synthetic leather was changed to 299 g/m$^2$, the non-woven fabric obtained by the above method was used as a fiber base material layer, the unit weight of the synthetic leather after being bonded to a film changed to 430 g/m$^2$, and the thickness changed to 1.51 mm. The penetration depth of the resin layer and the adhesive layer into the fiber base material layer calculated from the SEM photograph of the cross section of the obtained synthetic leather was 0.33 mm.

Evaluation of Various Physical Properties

The mechanical properties and wear durability are as shown in Table 2, and sufficient physical properties as a synthetic leather were satisfied. In addition, in the flame retardant test for automobile interior materials, the synthetic leather was burned beyond the 38 mm marked line, but the combustion speed was 26 mm/min, which was a favorable result. Both after-flame and drip combustion were not observed in the flame retardant test for aircraft interior materials, and favorable results were obtained with a burn length of 65 mm in the machine direction and 70 mm in the transverse direction. The obtained synthetic leather covered a urethane cushion and a flame retardant test of the sheet cushion was performed and, as a result, the burn length was within the pass range, and the mass loss was 9.7%, which was within the pass range. In addition, the texture of the obtained cushion was soft and good.

Example 7

Production of Fiber Base Material Layer

The drawn PPS fiber was changed to an as-spun PPS fiber to obtain a non-woven fabric having a unit weight of 193 g/m$^2$ in the same manner as in Example 1, and then the non-woven fabric was brought into contact with two S-shaped iron rolls heated to 190° C. to densely form a film, thereby obtaining a fiber base material layer having a thickness of 1.01 mm.

Production of Synthetic Leather

A synthetic leather was produced in the same manner as in Example 1, except that the unit weight after drying of the polyurethane resin D-1 and the flame retardant constituting the wet synthetic leather was changed to 190 g/m$^2$, the non-woven fabric obtained by the above method was used as a fiber base material layer, the unit weight of the synthetic leather after being bonded to a film changed to 429 g/m$^2$, and the thickness changed to 1.65 mm. The penetration depth of the resin layer and the adhesive layer into the fiber base material layer calculated from the SEM photograph of the cross section of the obtained synthetic leather was 0.04 mm.

Evaluation of Various Physical Properties

The mechanical properties and wear durability were as shown in Table 2, and the peel strength was 1.3 kgf (12.7 N)/25.4 mm in the machine direction and 1.5 kgf (14.7 N)/25.4 mm in the transverse direction, but sufficient physical properties as a synthetic leather were satisfied. In addition, self-extinguishing in a 38 mm marked line was observed in the flame retardant test for automobile interior materials, both after-flame and drip combustion were not observed in the flame retardant test for aircraft interior materials, and favorable results were obtained with a burn length of 69 mm in the machine direction and 64 mm in the transverse direction. The obtained synthetic leather covered a urethane cushion and a flame retardant test of the sheet cushion was performed and, as a result, the burn length was within the pass range, and the mass loss was 5.1%, which was within the pass range. In addition, the texture of the obtained cushion was soft and good.

Example 8

Production of Fiber Base Material Layer

A non-woven fabric was produced in the same manner as in Example 1, except that the unit weight was 181 g/m$^2$ and the thickness was 1.51 mm.

Production of Synthetic Leather

A synthetic leather was produced in the same manner as in Example 1, except that the unit weight after drying of the polyurethane resin D-1 and the flame retardant constituting the wet synthetic leather was changed to 162 g/m$^2$, the non-woven fabric obtained by the above method was used as a fiber base material layer, the unit weight of the synthetic leather after being bonded to a film changed to 391 g/m$^2$, and the thickness changed to 1.29 mm. The penetration depth of the resin layer and the adhesive layer into the fiber base material layer calculated from the SEM photograph of the cross section of the obtained synthetic leather was 0.72 mm.

Evaluation of Various Physical Properties

The mechanical properties and wear durability are as shown in Table 2, and sufficient physical properties as a synthetic leather were satisfied. In addition, self-extinguishing in a 38 mm marked line was observed in the flame retardant test for automobile interior materials, both after-flame and drip combustion were not observed in the flame retardant test for aircraft interior materials, and favorable results were obtained with a burn length of 50 mm in the machine direction and 54 mm in the transverse direction. The obtained synthetic leather covered a urethane cushion and a flame retardant test of the sheet cushion was performed and, as a result, the burn length was within the pass range, and the mass loss was 5.4%, which was within the pass range. In addition, the texture of the obtained cushion was slightly hard, and the average score of the sensory evaluation was 3.2 points.

Comparative Example 1

Production of Fiber Base Material Layer

A non-woven fabric was produced in the same manner as in Example 1, except that only the meta-aramid fiber was used, the unit weight was 178 g/m$^2$, and the thickness was 1.49 mm.

Production of Synthetic Leather

A synthetic leather was produced in the same manner as in Example 1, except that the unit weight after drying of the polyurethane resin D-1 and the flame retardant constituting the wet synthetic leather was changed to 204 g/m$^2$, the non-woven fabric obtained by the above method was used as a fiber base material layer, the unit weight of the synthetic leather after being bonded to a film changed to 432 g/m$^2$, and the thickness changed to 1.31 mm.

The penetration depth of the resin layer and the adhesive layer into the fiber base material layer, calculated from the SEM photograph of cross section of the obtained synthetic leather, was 0.39 mm.

Evaluation of Various Physical Properties

The mechanical properties and wear durability are as shown in Table 3, and sufficient physical properties as a synthetic leather were satisfied. In addition, self-extinguishing in a 38 mm marked line was observed in the flame retardant test for automobile interior materials, both after-flame and drip combustion were not observed in the flame retardant test for aircraft interior materials, and favorable results were obtained with a burn length of 52 mm in the machine direction and 54 mm in the transverse direction. The obtained synthetic leather covered a urethane cushion and a flame retardant test of the sheet cushion was performed and, as a result, the burn length was within the pass range, but the mass loss was 10.6%, which failed. The texture of the obtained cushion was soft and good.

Comparative Example 2

Production of Fiber Base Material Layer

A non-woven fabric was produced in the same manner as in Example 1, except that a PET fiber and a rayon fiber were used as the fibers, the mass ratio of the PET fiber to the rayon fiber was 65:35, the unit weight was 179 g/m$^2$, and the thickness was 1.34 mm.

Production of Synthetic Leather

A synthetic leather was produced in the same manner as in Example 1, except that the unit weight after drying of the polyurethane resin D-1 and the flame retardant constituting the wet synthetic leather was changed to 195 g/m$^2$, the non-woven fabric obtained by the above method was used as a fiber base material layer, the unit weight of the synthetic leather after being bonded to a film changed to 422 g/m$^2$, and the thickness changed to 1.42 mm. The penetration depth of the resin layer and the adhesive layer into the fiber base material layer calculated from the SEM photograph of the cross section of the obtained synthetic leather was 0.45 mm.

Evaluation of Various Physical Properties

The mechanical properties and wear durability are as shown in Table 3, and sufficient physical properties as a synthetic leather were satisfied. In addition, in the flame retardant test for automobile interior materials, the synthetic leather was burned beyond the 38 mm marked line, but the combustion speed was 98 mm/min, which was within the pass range. In the flame retardant test for aircraft interior materials, the synthetic leather with after-flame of 3.4 seconds in the machine direction and 3.2 seconds in the transverse direction, a drip combustion of 1.2 seconds in the machine direction and 1.9 seconds in the transverse direction, and a burn length of 167 mm in the machine direction and 169 mm in the transverse direction was within the pass range. The obtained synthetic leather covered a urethane cushion and a flame retardant test of the sheet cushion was performed and, as a result, the burn length failed and the mass loss was 24.7%, which failed. The texture of the obtained cushion was soft and good.

TABLE 1

| | | | Example 1 | Example 2 | Example 3 | Example 4 |
|---|---|---|---|---|---|---|
| Fiber base material layer | Non-melting fiber A | | Flameproofed fiber 60% by mass | Flameproofed fiber 60% by mass | Flameproofed fiber 10% by mass | Flameproofed fiber 85% by mass |
| | Thermoplastic fiber B | | Drawn PPS fiber 40% by mass | Drawn PPS fiber 40% by mass | Drawn PPS fiber 90% by mass | Drawn PPS fiber 15% by mass |
| | Other fiber C | | — | — | — | — |
| | Thickness before lamination of resin layer [mm] | | 1.51 | 1.57 | 1.42 | 1.59 |
| | Unit weight of fiber base material layer [g/m$^2$] | | 181 | 231 | 178 | 171 |
| Resin layer/ adhesive layer | First resin layer | Resin | Polyurethane resin D-1 100 parts by mass | Polyurethane resin D-1 100 parts by mass | Polyurethane resin D-1 100 parts by mass | Polyurethane resin D-1 100 parts by mass |
| | | Flame retardant | Aluminum diethylphosphinate 15 parts by mass | Aluminum diethylphosphinate 15 parts by mass | Aluminum diethylphosphinate 15 parts by mass | Aluminum diethylphosphinate 15 parts by mass |
| | Adhesive layer | Adhesive | Polycarbonate type polyurethane 100 parts by mass | Polycarbonate type polyurethane 100 parts by mass | Polycarbonate type polyurethane 100 parts by mass | Polycarbonate type polyurethane 100 parts by mass |
| | | Flame retardant | Aluminum diethylphosphinate 10 parts by mass | Aluminum diethylphosphinate 10 parts by mass | Aluminum diethylphosphinate 10 parts by mass | Aluminum diethylphosphinate 10 parts by mass |
| | Second resin layer | Resin | Polyurethane resin D-2 | Polyurethane resin D-2 | Polyurethane resin D-2 | Polyurethane resin D-2 |
| | Penetration depth of resin layer/adhesive layer into fiber base material layer [mm] | | 0.29 | 0.21 | 0.19 | 0.31 |
| | Unit weight of resin layer/adhesive layer [g/m$^2$] | | 234 | 182 | 231 | 223 |
| Synthetic leather | Thickness [mm] | | 1.32 | 1.39 | 1.34 | 1.43 |
| | Unit weight [g/m$^2$] | | MD 413 | 409 | 394 | |
| | Mass ratio of fiber base material layer to entire [%] | | 43.6 | 55.9 | 43.5 | 43.4 |
| | Tensile strength [N/25.4 mm] | | MD: 87.1 TD: 100.9 | MD: 89.2 TD: 99.9 | MD: 90.3 TD: 103.9 | MD: 77.3 TD: 91.3 |
| | Tensile elongation [%] | | MD: 63 TD: 89 | MD: 61 TD: 80 | MD: 62 TD: 85 | MD: 56 TD: 80 |
| | Tear strength [N] | | MD: 129.4 TD: 61.7 | MD: 132.3 TD: 67.6 | MD: 139.2 TD: 69.6 | MD: 110.7 TD: 58.8 |
| | Peel strength [N/25.4 mm] | | MD: 17.6 TD: 18.6 | MD: 16.7 TD: 18.6 | MD: 16.7 TD: 19.6 | MD: 17.6 TD: 16.7 |
| | Wear durability | | A No scratch | A No scratch | A No scratch | A No scratch |

TABLE 1-continued

| | Example 1 | Example 2 | Example 3 | Example 4 |
|---|---|---|---|---|
| Seam strength [N] | MD: 413<br>TD: 197 | MD: 428<br>TD: 207 | MD: 468<br>TD: 207 | MD: 401<br>TD: 183 |
| Flame retardant test for automobile interior materials | A<br>Self-extinguishing in 38 mm marked line | A<br>Self-extinguishing in 38 mm marked line | A<br>Self-extinguishing in 38 mm marked line | A<br>Self-extinguishing in 38 mm marked line |
| Flame retardant test for aircraft interior materials (Machine Direction(MD)/ Transverse Direction(TD)) | A<br>After-flame:<br>0.0 sec/0.0 sec<br>Drip:<br>0.0 sec/0.0 sec<br>Burn length:<br>61 mm/69 mm | A<br>After-flame:<br>0.0 sec/0.0 sec<br>Drip:<br>0.0 sec/0.0 sec<br>Burn length:<br>58 mm/60 mm | A<br>After-flame:<br>0.0 sec/0.0 sec<br>Drip:<br>0.0 sec/0.0 sec<br>Burn length:<br>120 mm/110 mm | A<br>After-flame:<br>0.0 sec/0.0 sec<br>Drip:<br>0.0 sec/0.0 sec<br>Burn length:<br>65 mm/70 mm |
| Flame retardant test of seat cushion | A | A | B | B |
| Burn length [mm] (front of back surface)/(rear of back surface)/(bottom portion of seat surface)/(upper portion of seat surface) | Burn length:<br>266/0/400/190 | Burn length:<br>232/0/254/175 | Burn length:<br>268/20/420/223 | Burn length:<br>230/0/398/1195 |
| Mass loss [%] | Mass loss:<br>4.9 | Mass loss:<br>3.9 | Mass loss:<br>9.5 | Mass loss:<br>8.1 |
| Sensory evaluation of texture of cushion | 4.6 | 4.4 | 4.4 | 4.4 |

TABLE 2

| | | | Example 5 | Example 6 | Example 7 | Example 8 |
|---|---|---|---|---|---|---|
| Fiber base material layer | Non-melting fiber A | | Flameproofed fiber<br>40% by mass | Flameproofed fiber<br>60% by mass | Flameproofed fiber<br>60% by mass | Flameproofed fiber<br>60% by mass |
| | Thermoplastic fiber B | | Drawn PPS fiber<br>30% by mass | Drawn PPS fiber<br>40% by mass | As-spun PPS fiber<br>40% by mass | Drawn PPS fiber<br>40% by mass |
| | Other fiber C | | PET fiber<br>30% by mass | — | — | — |
| | Thickness before lamination of resin layer [mm] | | 1.49 | 0.83 | 1.01 | 1.51 |
| | Unit weight of fiber base material layer [g/m$^2$] | | 179 | 82 | 193 | 181 |
| Resin layer/ adhesive layer | First resin layer | Resin | Polyurethane resin D-1<br>100 parts by mass | Polyurethane resin D-1<br>100 parts by mass | Polyurethane resin D-1<br>100 parts by mass | Polyurethane resin D-1<br>100 parts by mass |
| | | Flame retardant | Aluminum diethylphosphinate<br>15 parts by mass | Aluminum diethylphosphinate<br>15 parts by mass | Aluminum diethylphosphinate<br>15 parts by mass | Aluminum diethylphosphinate<br>15 parts by mass |
| | Adhesive layer | Adhesive | Polycarbonate type polyurethane<br>100 parts by mass | Polycarbonate type polyurethane<br>100 parts by mass | Polycarbonate type polyurethane<br>100 parts by mass | Polycarbonate type polyurethane<br>100 parts by mass |
| | | Flame retardant | Aluminum diethylphosphinate<br>10 parts by mass | Aluminum diethylphosphinate<br>10 parts by mass | Aluminum diethylphosphinate<br>10 parts by mass | Aluminum diethylphosphinate<br>10 parts by mass |
| | Second resin layer | Resin | Polyurethane resin D-2 | Polyurethane resin D-2 | Polyurethane resin D-2 | Polyurethane resin D-2 |
| | Penetration depth of resin layer/adhesive layer into fiber base material layer [mm] | | 0.35 | 0.33 | 0.04 | 0.72 |
| | Unit weight of resin layer/adhesive layer [g/m$^2$] | | 222 | 348 | 236 | 210 |
| Synthetic leather | Thickness [mm] | | 1.35 | 1.51 | 1.65 | 1.29 |
| | Unit weight [g/m$^2$] | | 401 | 430 | 429 | 391 |
| | Mass ratio of fiber base material layer to entire [%] | | 44.6 | 19.1 | 45.0 | 46.3 |
| | Tensile strength [N/25.4 mm] | | MD: 89.4<br>TD: 102.9 | MD: 54.5<br>TD 58.6 | MD: 86.9<br>TD 103.9 | MD: 88.3<br>TD: 99.0 |
| | Tensile elongation [%] | | MD: 68<br>TD: 98 | MD: 42<br>TD: 68 | MD: 60<br>TD: 78 | MD: 58<br>TD: 71 |
| | Tear strength [N] | | MD: 142.1<br>TD: 68.6 | MD: 90.2<br>TD: 47.1 | MD: 120.5<br>TD: 58.8 | MD: 96.0<br>TD: 66.6 |
| | Peel strength [N/25.4 mm] | | MD: 19.6<br>TD: 22.5 | MD: 18.6<br>TD: 17.6 | MD: 12.7<br>TD: 14.7 | MD: 24.5<br>TD: 25.5 |
| | Wear durability | | A<br>No scratch | A<br>No scratch | A<br>No scratch | A<br>No scratch |
| | Seam strength [N] | | MD: 420<br>TD: 207 | MD: 296<br>TD: 170 | MD: 319<br>TD: 193 | MD: 411<br>TD: 219 |

TABLE 2-continued

| | Example 5 | Example 6 | Example 7 | Example 8 |
|---|---|---|---|---|
| Flame retardant test for automobile interior materials | B<br>78 mm/min | A<br>26 mm/min | A<br>Self-extinguishing in 38 mm marked line | A<br>Self-extinguishing in 38 mm marked line |
| Flame retardant test for aircraft interior materials (Machine Direction(MD)/ Transverse Direction(TD)) | A<br>After-flame:<br>1.2 sec/1.5 sec<br>Drip:<br>0.5 sec/1.0 sec<br>Burn length:<br>109 mm/119 mm | A<br>After-flame:<br>0.0 sec/0.0 sec<br>Drip:<br>0.0 sec/0.0 sec<br>Burn length:<br>89 mm/83 mm | A<br>After-flame:<br>0.0 sec/0.0 sec<br>Drip:<br>0.0 sec/0.0 sec<br>Burn length:<br>69 mm /64 mm | A<br>After-flame:<br>0.0 sec/0.0 sec<br>Drip:<br>0.0 sec/0.0 sec<br>Burn length:<br>50 mm/54 mm |
| Flame retardant test of seat cushion Burn length [mm] (front of back surface)/(rear of back surface)/(bottom portion of seat surface)/(upper portion of seat surface) | B<br>Burn length:<br>326/103/420/299 | B<br>Burn length:<br>290/10/428/223 | B<br>Burn length:<br>279/9/388/184 | B<br>Burn length:<br>301/0/375/197 |
| Mass loss [%] | 9.9 | 9.7 | 5.1 | 5.4 |
| Sensory evaluation of texture of cushion | 4.4 | 4.6 | 4.2 | 3.2 |

TABLE 3

| | | | Comparative Example 1 | Comparative Example 2 |
|---|---|---|---|---|
| Fiber base material layer | Non-melting fiber A | | — | — |
| | Thermoplastic fiber B | | — | — |
| | Other fiber C | | Meta-aramid fiber 100% by mass | 65% by mass of PET fiber/ 35% by mass of rayon |
| | Thickness before lamination of resin layer [mm] | | 1.49 | 1.34 |
| | Unit weight of fiber base material layer [g/m$^2$] | | 178 | 179 |
| Resin layer/ adhesive layer | First resin layer | Resin | Polyurethane resin D-1 100 parts by mass | Polyurethane resin D-1 100 parts by mass |
| | | Flame retardant | Aluminum diethylphosphinate 15 parts by mass | Aluminum diethylphosphinate 15 parts by mass |
| | Adhesive layer | Adhesive | Polycarbonate type polyurethane 100 parts by mass | Polycarbonate type polyurethane 100 parts by mass |
| | | Flame retardant | Aluminum diethylphosphinate 10 parts by mass | Aluminum diethylphosphinate 10 parts by mass |
| | Second resin layer | Resin | Polyurethane resin D-2 | Polyurethane resin D-2 |
| | Penetration depth of resin layer/adhesive layer into fiber base material layer [mm] | | 0.39 | 0.45 |
| | Unit weight of resin layer/adhesive layer [g/m$^2$] | | 254 | 243 |
| Synthetic leather | Thickness [mm] | | 1.31 | 1.42 |
| | Unit weight [g/m$^2$] | | 432 | 422 |
| | Mass ratio of fiber base material layer to entire [%] | | 41.2 | 42.4 |
| | Tensile strength [N/25.4 mm] | | MD: 110.7<br>TD: 125.4 | MD: 89.4<br>TD: 99.0 |
| | Tensile elongation [%] | | MD: 78<br>TD: 101 | MD: 78<br>TD: 98 |
| | Tear strength [N] | | MD: 161.7<br>TD: 140.1 | MD: 135.2<br>TD: 67.6 |
| | Peel strength [N/25.4 mm] | | MD: 22.5<br>TD: 21.6 | MD: 18.6<br>TD: 21.6 |
| | Wear durability | | A<br>No scratch | A<br>No scratch |
| | Seam strength [N] | | MD: 414<br>TD: 197 | MD: 420<br>TD: 214 |
| | Flame retardant test for automobile interior materials | | A<br>Self-extinguishing in 38 mm marked line | B<br>98 mm/min |
| | Flame retardant test for aircraft interior materials (Machine Direction(MD)/ Transverse Direction(TD)) | | A<br>After-flame:<br>0.0 sec/0.0 sec<br>Drip: 0.0 sec/1.0 sec<br>Burn length: 52 mm/54 mm | A<br>After-flame:<br>3.4 sec/3.2 sec<br>Drip: 1.2 sec/1.9 sec<br>Burn length: 167 mm/169 mm |

TABLE 3-continued

| | Comparative Example 1 | Comparative Example 2 |
|---|---|---|
| Flame retardant test of seat cushion | F | F |
| Burn length [mm] (front of back surface)/(rear of back surface)/(bottom portion of seat surface)/(upper portion of seat surface) | Burn length: 254/0/298/178 | Burn length: >432/235/>432/308 |
| Mass loss [%] | Mass loss: 10.6 | Mass loss: 24.7 |
| Sensory evaluation of texture of cushion | 4.0 | 4.4 |

INDUSTRIAL APPLICABILITY

My synthetic leather and articles have excellent flame retardance, exhibit an excellent fire spread prevention effect when covering a combustible material, and have excellent physical properties such as texture and peel strength and, thus, can be suitably used for interior materials of automobiles, railways, ships and the like (seats, headrests, tonneau covers, sun visors, ceilings and the like), interior materials of high-rise buildings and public facilities, skin materials of furniture (chair, sofa and the like), and the like, and can be particularly suitably used for seat interiors of aircraft that require high flame retardance.

The invention claimed is:

1. A synthetic leather comprising a fiber base material layer formed of a non-woven fabric, the non-woven fabric including: a non-melting fiber A having a high-temperature shrinkage rate of 3% or less and a thermal conductivity, conforming to ISO22007-3 (2008), of 0.060 W/m·K or less, and a thermoplastic fiber B having a Limiting Oxygen Index (LOI) value, conforming to JIS K 7201-2 (2007), of 25 or more, wherein the non-melting fiber A is a flameproofed fiber or a meta-aramid-based fiber and a density of the non-woven fabric is more than 50 kg/m$^3$ and 180 kg/m$^3$ or less.

2. The synthetic leather according to claim 1, further comprising a resin layer formed on the fiber base material layer.

3. The synthetic leather according to claim 2, wherein in the synthetic leather, a penetration depth of a resin layer into the fiber base material layer is 0.05 to 0.40 mm.

4. The synthetic leather according to claim 2, further comprising an adhesive layer provided between the fiber base material layer and the resin layer.

5. The synthetic leather according to claim 4, wherein a penetration depth of a resin layer or the adhesive layer into the fiber base material layer is 0.05 to 0.40 mm.

6. The synthetic leather according to claim 1, wherein a content of the non-melting fiber A is 15 to 70% by mass in the fiber base material layer.

7. The synthetic leather according to claim 1, wherein 20% by mass or less of fiber C other than the non-melting fiber A and the thermoplastic fiber B is included.

8. The synthetic leather according to claim 1, wherein the thermoplastic fiber B is a fiber formed of a resin selected from the group consisting of flame retardant liquid crystalline polyester, flame-retardant poly(alkylene terephthalate), flame-retardant poly(acryl-onitrile butadiene styrene), flame-retardant polysulfone, poly(ether-ether-ketone), poly (ether-ketone-ketone), polyethersulfone, polyarylate, polyarylene sulfide, polyphenylsulfone, poly-etherimide, polyamideimide, and mixtures thereof.

9. The synthetic leather according to claim 1, wherein the thermoplastic fiber B is a fiber containing 15% by mass or more of a sulfur atom.

10. The synthetic leather according to claim 1, wherein a mass ratio of the fiber base material layer in the synthetic leather is 20 to 80% by mass.

11. A covered article covered with the synthetic leather according to claim 1.

12. The covered article according to claim 11, wherein the article is a seat cushion material mounted on an aircraft, an automobile, or a ship.

* * * * *